US010928130B2

(12) United States Patent
Lin et al.

(10) Patent No.: US 10,928,130 B2
(45) Date of Patent: Feb. 23, 2021

(54) DRYING SYSTEM AND DRYING METHOD FOR CLEANING SOLUTION ON MASK

(71) Applicants: Ordos Yuansheng Optoelectronics Co., Ltd., Inner Mongolia (CN); BOE Technology Group Co., Ltd., Beijing (CN)

(72) Inventors: Zhiming Lin, Beijing (CN); Zhen Wang, Beijing (CN); Baojun Li, Beijing (CN); Zhi Yin, Beijing (CN); Chun-Chieh Huang, Beijing (CN)

(73) Assignees: ORDOS YUANSHENG OPTOELECTRONICS CO., LTD., Inner Mongolia (CN); BOE TECHNOLOGY GROUP CO., LTD., Beijing (CN)

( * ) Notice: Subject to any disclaimer, the term of this patent is extended or adjusted under 35 U.S.C. 154(b) by 253 days.

(21) Appl. No.: 16/316,748

(22) PCT Filed: Jan. 5, 2018

(86) PCT No.: PCT/CN2018/071592
§ 371 (c)(1),
(2) Date: Jan. 10, 2019

(87) PCT Pub. No.: WO2018/209981
PCT Pub. Date: Nov. 22, 2018

(65) Prior Publication Data

US 2019/0316840 A1 Oct. 17, 2019

(30) Foreign Application Priority Data

May 17, 2017 (CN) ..... 201710347983.X

(51) Int. Cl.
*F26B 5/00* (2006.01)
*F26B 21/00* (2006.01)
(Continued)

(52) U.S. Cl.
CPC ..... *F26B 5/00* (2013.01); *F26B 21/004* (2013.01); *F26B 21/12* (2013.01); *F26B 25/00* (2013.01); *B08B 5/02* (2013.01)

(58) Field of Classification Search
CPC ..... F26B 5/00; F26B 21/004; F26B 21/12; F26B 25/00; B08B 5/02
(Continued)

(56) References Cited

U.S. PATENT DOCUMENTS 5,524,363 A * 6/1996 Seidl ..... F26B 13/104 34/629
6,073,369 A * 6/2000 Yasuyuki ..... F26B 21/004 34/651
(Continued)

FOREIGN PATENT DOCUMENTS

CN 1894780 A 1/2007
CN 101728237 A 6/2010
(Continued)

OTHER PUBLICATIONS

International Search Report (English translation) and Written Opinion (including English translation of Box V) for International Application No. PCT/CN2018/071592, dated Mar. 20, 2018, 8 pages.

*Primary Examiner* — Jessica Yuen
(74) *Attorney, Agent, or Firm* — Westman, Champlin & Koehler, P.A.

(57) ABSTRACT

A drying system and a drying method for a cleaning solution on a mask are disclosed. The drying system includes: a drying chamber having a first side wall and a second side wall arranged opposite to the first side wall; a plurality of first air knives on the first side wall and the second side wall for air-drying a cleaned mask; and a separation device for allowing a mask strip and a supporting and shielding strip to move away from each other at a spatial intersection region
(Continued)

to increase a spacing between the mask strip and the supporting and shielding strip at the spatial intersection region, when the plurality of first air knives are air-drying the cleaned mask.

20 Claims, 5 Drawing Sheets

(51) Int. Cl.
*F26B 21/12* (2006.01)
*F26B 25/00* (2006.01)
*B08B 5/02* (2006.01)

(58) Field of Classification Search
USPC ..... 34/641, 643
See application file for complete search history.

(56) References Cited

U.S. PATENT DOCUMENTS

| | | | |
|---|---|---|---|
| 2007/0281094 | A1 | 12/2007 | Nishio et al. |
| 2010/0108104 | A1 | 5/2010 | Hsieh et al. |
| 2012/0037192 | A1 | 2/2012 | Hsieh et al. |

FOREIGN PATENT DOCUMENTS

| | | | |
|---|---|---|---|
| CN | 202494861 | U | 10/2012 |
| CN | 203170641 | U | 9/2013 |
| CN | 104438226 | A | 3/2015 |
| CN | 107120954 | A | 9/2017 |
| EP | 1 696 474 | A1 | 8/2006 |
| JP | 2005-241153 | A | 9/2005 |
| JP | 2006-261223 | A | 9/2006 |

* cited by examiner

DRYING SYSTEM AND DRYING METHOD FOR CLEANING SOLUTION ON MASK

CROSS-REFERENCE TO RELATED APPLICATION

This application is a Section 371 National Stage Application of International Application No. PCT/CN2018/071592, filed on Jan. 5, 2018, entitled "DRYING SYSTEM AND DRYING METHOD FOR CLEANING SOLUTION ON MASK", which claims priority to Chinese Patent Application No. 201710347983.X filed on May 17, 2017 with CNIPA, incorporated herein by reference in entirety.

BACKGROUND

Technical Field

Embodiments of the present disclosure relate to, but are not limited to, the field of liquid crystal display technology, and in particular, to a drying system and a drying method for a cleaning solution on a mask.

Description of the Related Art

In a fine metal mask mode, vapor deposition materials are vapor-deposited onto a back plate (for example, a low-temperature polysilicon back plate) by a manner of vapor deposition according to a predetermined procedure, and then red, green and blue organic substances are vapor-deposited to specified positions by means of a pattern on a high-precision metal mask.

The mask comprises a frame, supporting and shielding strips and mask strips, the supporting and shielding strips are of a non-ferromagnetic material, the mask strips are of a ferromagnetic material. The mask strip and the supporting and shielding strip intersect in space to form a spatial intersection region. There is a relatively small distance between the mask strip and the supporting and shielding strip at the spatial intersection region (There is a narrow gap between the mask strip and the supporting and shielding strip), and it is difficult for a cleaning solution accumulated at the spatial intersection region to be cleaned during cleaning. Air knives are provided at both sides of the mask in the conventional drying system, and there are two air knives at each side (the air knives have the same air volume when they are symmetrically arranged at both sides). After the mask is cleaned with the cleaning solution, the wind cannot completely enter into the spatial intersection region between the mask strip and the supporting and shielding strip during the drying process. After the end of drying, the cleaning solution still remains in the spatial intersection region between the mask strip and the supporting and shielding strip on the mask. If the cleaning solution accumulates for a long time, it will deteriorate and crystallize, and eventually form particulate matter, which will adversely affect quality of the vapor-deposited product.

SUMMARY

There is provided in an embodiment of the present disclosure a drying system, comprising:

a drying chamber having a first side wall and a second side wall arranged opposite to the first side wall;

a plurality of first air knives on the first side wall and the second side wall for air-drying a cleaned mask; and a separation device for allowing a mask strip and a supporting and shielding strip to move away from each other at a spatial intersection region formed by the mask strip and the supporting and shielding strip to increase a spacing between the mask strip and the supporting and shielding strip at the spatial intersection region, when the plurality of first air knives are air-drying the cleaned mask.

As an example, the separation device comprises a magnetic adsorbing member.

As an example, the magnetic adsorbing member comprises a magnet or an electromagnet.

As an example, the separation device comprises second air knives disposed symmetrically on the first side wall and the second side wall, and the second air knife on the first side wall has a different air volume from the second air knife on the second side wall.

As an example, the separation device comprises second air knives disposed on the first side wall and the second side wall in a staggered manner.

As an example, the second air knife on the first side wall and the second air knife on the second side wall are staggered relative to each other in an up-down direction, and the second air knife on the first side wall has a same air volume as the second air knife on the second side wall.

As an example, the plurality of first air knives form a plurality of groups of first air knives arranged at intervals in an up-down direction, and any one group of the plurality of groups of first air knives has a same air volume, and the separation device is disposed between two adjacent groups of first air knives in the up-down direction.

There is further provided in an embodiment of the present disclosure a drying method for a cleaning solution on a mask, comprising:

making a mask strip and a supporting and shielding strip move away from each other by a separation device at a spatial intersection region formed by the mask strip and the supporting and shielding strip to increase a spacing between the mask strip and the supporting and shielding strip at the spatial intersection region, so that the cleaning solution in the spatial intersection region is blown away, when the plurality of first air knives are air-drying the cleaned mask.

As an example, the making the mask strip and the supporting and shielding strip move away from each other by the separation device at the spatial intersection region formed by the mask strip and the supporting and shielding strip to increase the spacing between the mask strip and the supporting and shielding strip at the spatial intersection region comprises:

controlling symmetrically-disposed second air knives to blow the spatial intersection region with different air volumes, so that the mask strip and the supporting and shielding strip are moved away from each other by a resulting pressure difference of wind at the spatial intersection region to increase the spacing between the mask strip and the supporting and shielding strip at the spatial intersection region.

As an example, the making the mask strip and the supporting and shielding strip move away from each other by the separation device at the spatial intersection region formed by the mask strip and the supporting and shielding strip to increase the spacing between the mask strip and the supporting and shielding strip at the spatial intersection region comprises:

controlling second air knives disposed in a staggered manner to blow the spatial intersection region with a same air volume, so that the mask strip and the supporting and shielding strip are moved away from each other by a resulting pressure difference of wind from each other at the spatial intersection region to increase the spacing between the mask strip and the supporting and shielding strip at the spatial intersection region.

As an example, the making the mask strip and the supporting and shielding strip move away from each other by the separation device at the spatial intersection region formed by the mask strip and the supporting and shielding strip to increase the spacing between the mask strip and the supporting and shielding strip at the spatial intersection region comprises:

magnetically adsorbing by a magnetic adsorbing member the mask strip at the spatial intersection region, to bend and deform the mask strip at the spatial intersection region away from the supporting and shielding strip, so that the mask strip and the supporting and shielding strip are moved away from each other at the spatial intersection region to increase the spacing between the mask strip and the supporting and shielding strip at the spatial intersection region.

Other features and advantages of the embodiments of the present disclosure will be set forth in the following description, and they will be partially obvious in view of such a description or understood by those skilled in the art with reference to the embodiments of the present disclosure. Objectives and other advantages of the embodiments of the present disclosure can be realized and obtained by the structures particularly pointed out in the specification, the claims and the accompanying drawings.

BRIEF DESCRIPTION OF THE DRAWINGS

The drawings are used to provide a further understanding of technical solutions in the embodiments of the present disclosure, and constitute a part of the specification, and they are provided to explain the technical solutions in the embodiments of the present disclosure with reference to the embodiments of the present disclosure, but do not form a limitation to the technical solutions in the embodiments of the present disclosure.

DETAILED DESCRIPTION OF PREFERRED EMBODIMENTS

In order to make objectives, technical solutions and advantages of the embodiments of the present disclosure more clear, the embodiments of the present disclosure will be described in detail below with reference to the accompanying drawings. It should be noted that the embodiments of the present disclosure and the features in the embodiments may be arbitrarily combined with each other in case of no conflicts.

In the following description, numerous specific details are set forth in order to provide a thorough understanding of the present disclosure, however, the present disclosure may be implemented otherwise than as described herein. Therefore, the scope of the present disclosure is not limited by the following embodiments disclosed below.

There is provided in an embodiment of the present disclosure a drying system, by which a cleaning solution can be completely removed from a spatial intersection region when cleaning a mask, and the cleaning solution would not be accumulated in the spatial intersection region after performing the clean process, thereby effectively ensuring vapor deposition quality of the mask when it is applied to the subsequent vapor deposition.

A drying system and a drying method for a cleaning solution on a mask according to some embodiments of the present disclosure will be described below with reference to the accompanying drawings.

Figure 1:
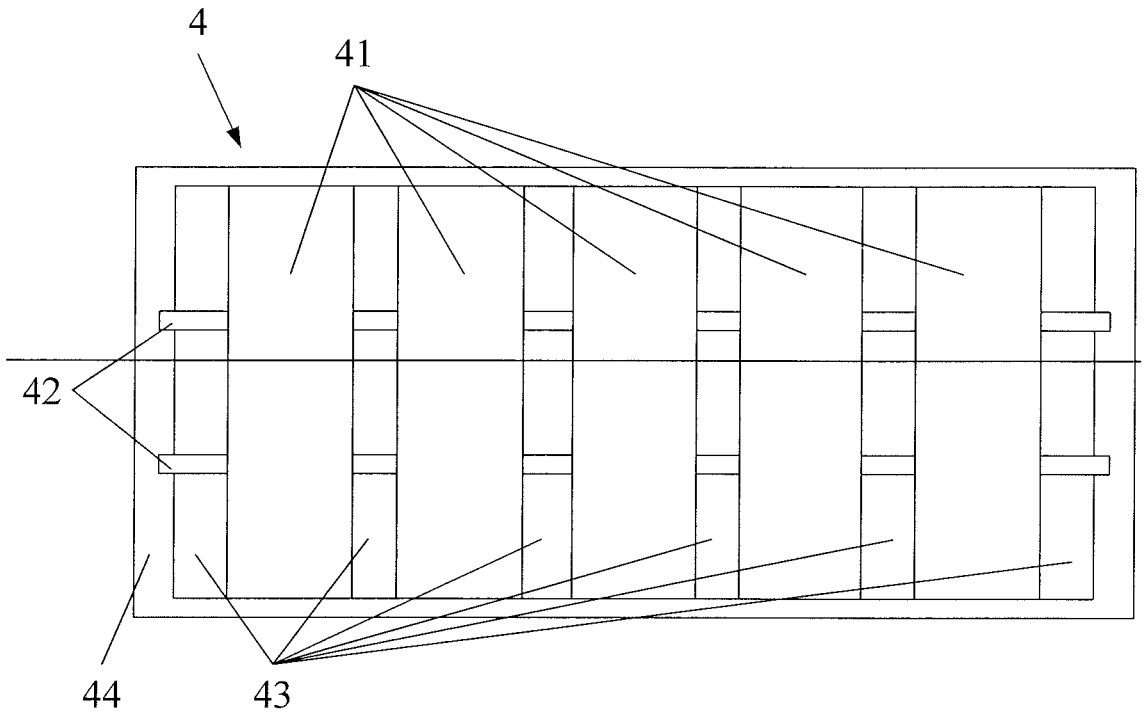
FIG. 1 is a schematic structural view of a mask in an embodiment of the present disclosure.
Figure 1:
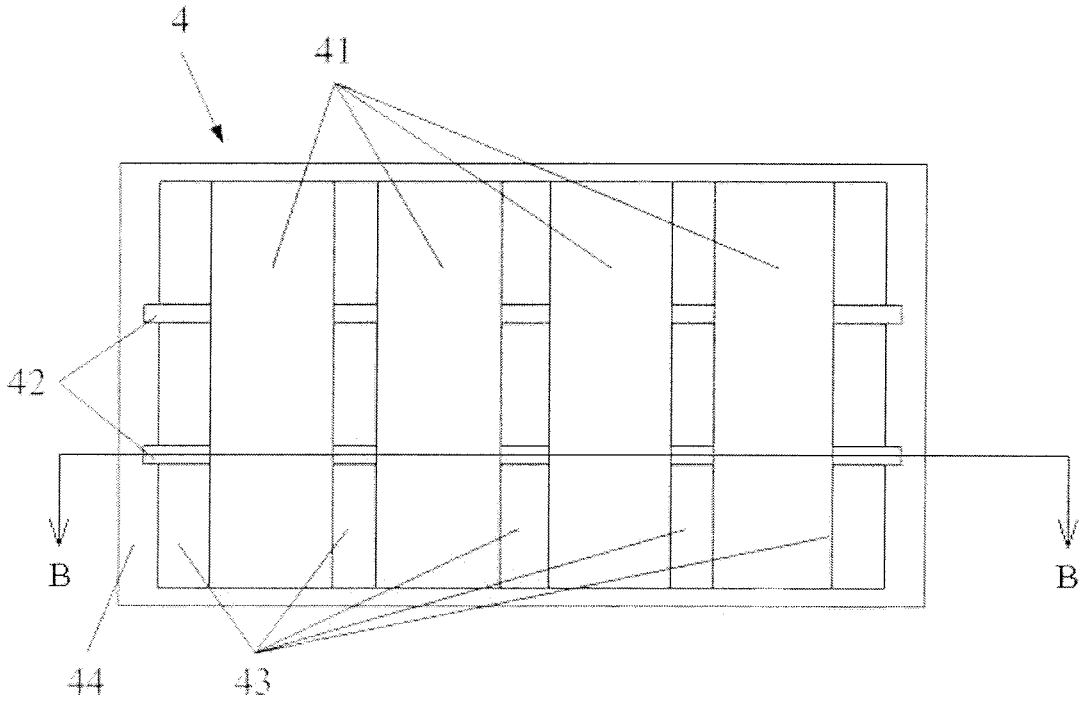
Figure 2:
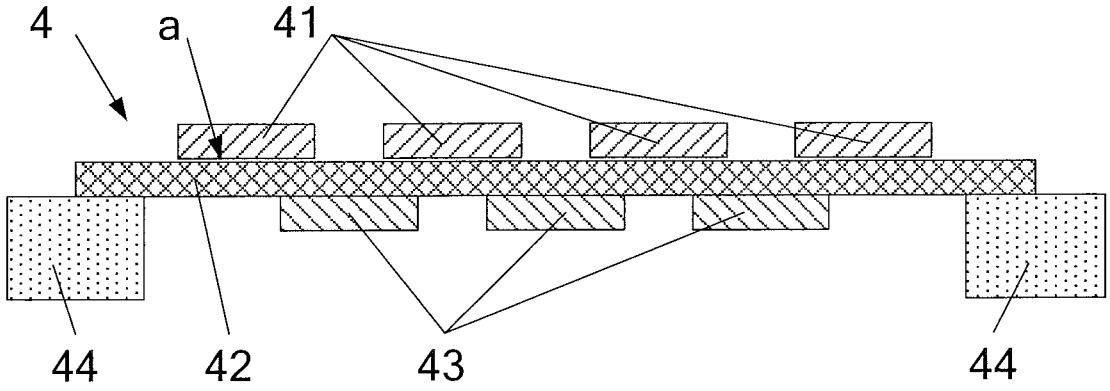
FIG. 2 is a schematic cross-sectional view of showing structure of the mask shown in FIG. 1 cut along line B-B in FIG. 1.

As shown in FIGS. 1 and 2, a mask 4 includes mask strips 41 and a supporting and shielding strip, the supporting and shielding strip includes a supporting strip 42 and a shielding strip 43, and the mask 4 further includes a frame 44. A plurality of mask strips 41 are arranged in parallel with each other, and a plurality of supporting strips 42 may be provided for supporting the mask strips 41 and disposed on one side of the mask strips 41. A plurality of shielding strips 43 may be disposed on the same side of the mask strips 41 as the supporting strips 42 and disposed on a side of the supporting strips 42 away from the mask strips 41. The supporting strips 42 are orthogonal to the mask strips 41, and the shielding strips 43 are parallel to the mask strips 41. As shown in FIG. 2, there is a spatial intersection region between the mask strip 41 and the supporting and shielding strip (specifically, the supporting strip 42), and there is a narrow gap in the spatial intersection region, see position a in the figure.

Figure 3:
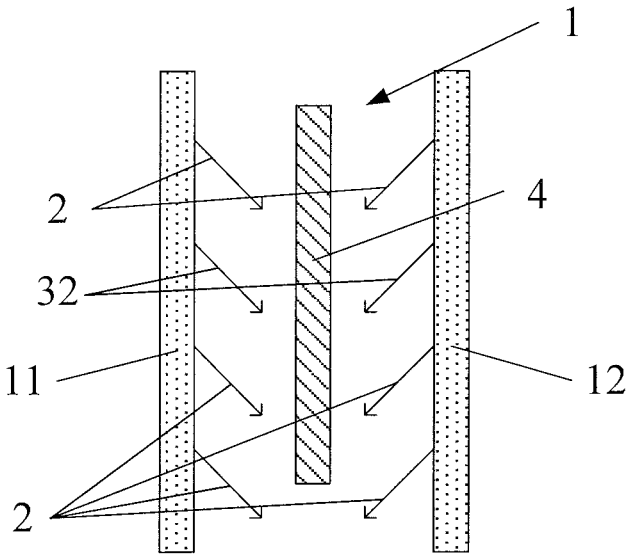
FIG. 3 is a schematic cross-sectional view of showing structure of a drying device according to an embodiment of the present disclosure.
Figure 4:
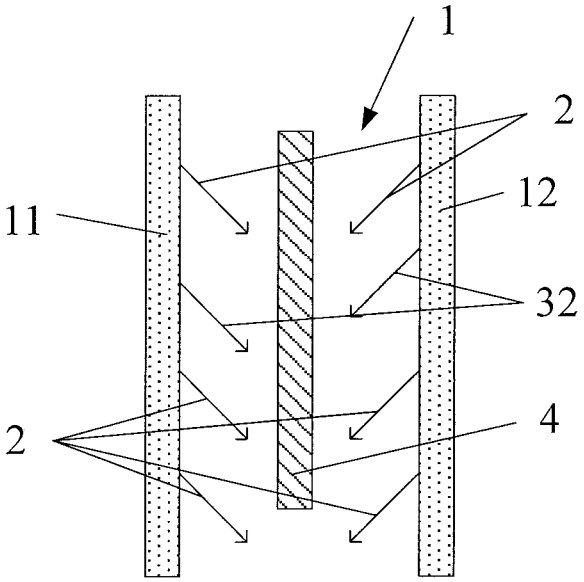
FIG. 4 is a schematic cross-sectional view of showing structure of a drying device according to an embodiment of the present disclosure.
Figure 5:
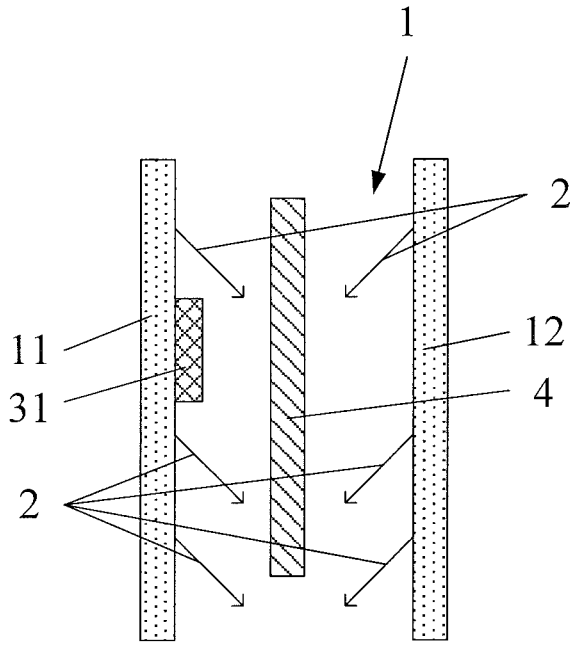
FIG. 5 is a schematic cross-sectional view of showing structure of a drying device according to an embodiment of the present disclosure.

The drying system provided by embodiments of the present disclosure is shown in FIGS. 3 to 5. The drying system comprises: a drying chamber 1 having a first side wall 11 and a second side wall 12 arranged opposite to the first side wall 11; a plurality of first air knives 2 disposed on the first side wall 11 and the second side wall 12 for air-drying a cleaned mask 4; and a separation device for allowing a mask strip 41 and a supporting and shielding strip to move away from each other at a spatial intersection region to increase a spacing between the mask strip 41 and the supporting and shielding strip in the spatial intersection region, when the plurality of first air knives 2 are air-drying the cleaned mask 4 (see the change of spacing at the position a between FIGS. 2 and 6). The spatial intersection region refers to a region in which a projection of the mask strip 41 on a surface of the mask strip 41 close to the supporting and shielding strip and a projection of the supporting and shielding strip on the same surface coincide with each other. When the drying system is in operation, the mask 4 is disposed between the first side wall 11 and the second side wall 12, and an extending surface of the mask 4 is parallel or substantially parallel to the first side wall 11 and the second side wall 12.

According to the drying system provided by the embodiments of the present disclosure, when the plurality of first air knives 2 air-dry the cleaned mask 4, the separation device allows the mask strip 41 and the supporting and shielding strip to move away from each other at the spatial intersection region, to increase the spacing between the mask strip 41 and the supporting and shielding strip at the spatial intersection region. As a result, it allows a better air circulation at the spatial intersection region, so that the cleaning solution in the spatial intersection region is blown away, avoiding the cleaning solution from remaining on the mask 4.

In a specific embodiment of the present disclosure, as shown in FIG. 3, the separation device includes second air knives 32, symmetrically disposed on the first side wall 11 and the second side wall 12, and the second air knives 32 on the first side wall 11 has a different air volume from the second air knives 32 on the second side wall 12. That is, the symmetrically-disposed second air knives 32 are controlled to blow the spatial intersection region with different air volumes, so that the mask strip 41 and the supporting and shielding strip are moved away from each other by a resulting pressure difference of wind at the spatial intersection region to increase the spacing between the mask strip 41 and the supporting and shielding strip in the spatial intersection region, which ensures that more wind can enter the spatial intersection region to dry the cleaning solution.

Herein, a tensile strength of the material of the mask strips 41 is less than a tensile strength of the material of the supporting and shielding strip.

In a specific embodiment of the present disclosure, as shown in FIG. 4, the separation device includes second air knives 32 disposed on the first side wall 11 and the second side in a staggered manner. That is, the second air knives 32 disposed in the staggered manner are controlled to blow the spatial intersection region with the same air volume or different air volumes, so that the mask strip 41 and the supporting and shielding strip are moved away from each other by a resulting pressure difference of wind (formed by the arrangement mode of stagger of the second air knives 32) at the spatial intersection region to increase the spacing between the mask strip 41 and the supporting and shielding strip in the spatial intersection region, which ensures that more wind can enter the spatial intersection region to dry the cleaning solution. Herein, the wording of the second air knives 32 is disposed on the first side wall 11 and the second side in a staggered manner means that a projection of the second air knife 32 disposed on the first side wall 11 on the first side wall 11 or the second side wall 12 does not overlap with a projection of the second air knife 32 disposed on the second side wall 12 on the corresponding side wall.

Herein, a tensile strength of the material of the mask strips 41 is less than a tensile strength of the material of the supporting and shielding strip.

Specifically, the second air knives 32 on the first side wall 11 and the second air knives 32 on the second side wall 12 are staggered relative to each other in an up-down direction, and the second air knives 32 on the first side wall 11 have a same air volume as the second air knives 32 on the second side wall 12; or, the second air knives 32 on the first side wall 11 and the second air knives 32 on the second side wall 12 are staggered relative to each other in a left-right direction, and the second air knives 32 on the first side wall 11 have a same air volume as the second air knives 32 on the second side wall 12, and so forth. The purpose of the present disclosure can be achieved by those designs, which do not deviate from the design idea of the present disclosure, and will not be described herein again, and those designs fall within the scope of the present disclosure. Herein, the stagger in the up-down direction refers to a stagger arrangement in a vertical direction at the time the drying system is in a working state when the mask is vertically arranged in the drying system, as the up-down direction shown in FIG. 4; and the stagger in an left-right direction refers to a stagger arraignment in a horizontal direction at the time the drying system is in a working state when the mask is horizontally arranged in the drying system, as the front-back direction (a direction of entering into and exiting from the paper) shown in FIG. 4.

In a specific embodiment of the present disclosure, as shown in FIG. 5, the separation device includes a magnetic adsorbing member 31, the supporting and shielding strip is of a non-ferromagnetic material, and the mask strip 41 is of a ferromagnetic material. When the cleaned mask 4 is subjected to air-drying, the mask strip 41 is located to face a side where the magnetic adsorbing member 31 is located. In this way, when the magnetic adsorbing member 31 magnetically adsorbs the mask strip 41, the mask strip 41 is partially bent and deformed in such a way that the mask strip 41 is bent away from the supporting and shielding strip at the spatial intersection region. As a result, the spacing between them is increased, ensuring that more wind can enter the spatial intersection region to dry the cleaning solution.

Further, the magnetic adsorbing member 31 is a magnet or an electromagnet, the supporting and shielding strip is made of stainless steel (for example, 304 stainless steel), and the mask strip 41 is made of iron-nickel alloy (for example, low-expansion iron-nickel alloy).

Specifically, the mask strip 41 is magnetically adsorbed by a magnetic adsorbing member 31 at the spatial intersection region, to bend and deform the mask strip 41 at the spatial intersection region away from the supporting and shielding strip, so that the mask strip 41 and the supporting and shielding strip are moved away from each other at the spatial intersection region to increase the spacing between the mask strip 41 and the supporting and shielding strip at the spatial intersection region, ensuring that more wind can enter the spatial intersection region to dry the cleaning solution.

In the foregoing three specific embodiments of the present disclosure, the plurality of first air knives 2 form a plurality of groups of first air knives arranged at intervals in an up-down direction (e.g., two groups, three groups, four groups, etc., all of which can achieve the purpose of the present disclosure), and any one group of the plurality of groups of first air knives 2 has a same air volume, and the separation device is disposed between two adjacent groups of first air knives 2 in the up-down direction. Herein the first air knives on the first side wall 11 and the first air knives on the second side wall 12 on the substantially same spatial position (for example, a position in a vertical direction in FIGS. 3-5, that is, a height position) form a group of first air knives.

The plurality of groups of first air knives 2 limit the position of the mask 4 and protect the mask, and keep the mask 4 from being deformed, the separation device only makes the mask strip 41 and the supporting and shielding strip at the spatial intersection region separate partially, the region where the mask strip 41 is separated from the supporting and shielding strip is relatively small relative to the entire mask 4, thereby the mask 4 can be prevented from being damaged.

With the drying method for the cleaning solution on the mask provided by the embodiments of the present disclosure, when the plurality of first air knives air-dry the cleaned mask, the mask strip and the supporting and shielding strip are driven by the separation device to move from each other at the spatial intersection region to increase the spacing between the mask strip and the supporting and shielding strip at the spatial intersection region, so that the cleaning solution in the spatial intersection region is blown away.

When the plurality of first air knives air-dry the cleaned mask, the separation device separates the mask strip from the supporting and shielding strip at the spatial intersection region, to open the spatial intersection region of the mask strip and the supporting and shielding strip to allow an air circulation, so that the cleaning solution in the spatial intersection region of the mask strip and the supporting and shielding strip is blown-dry, avoiding the cleaning solution from remaining on the mask.

Figure 6:
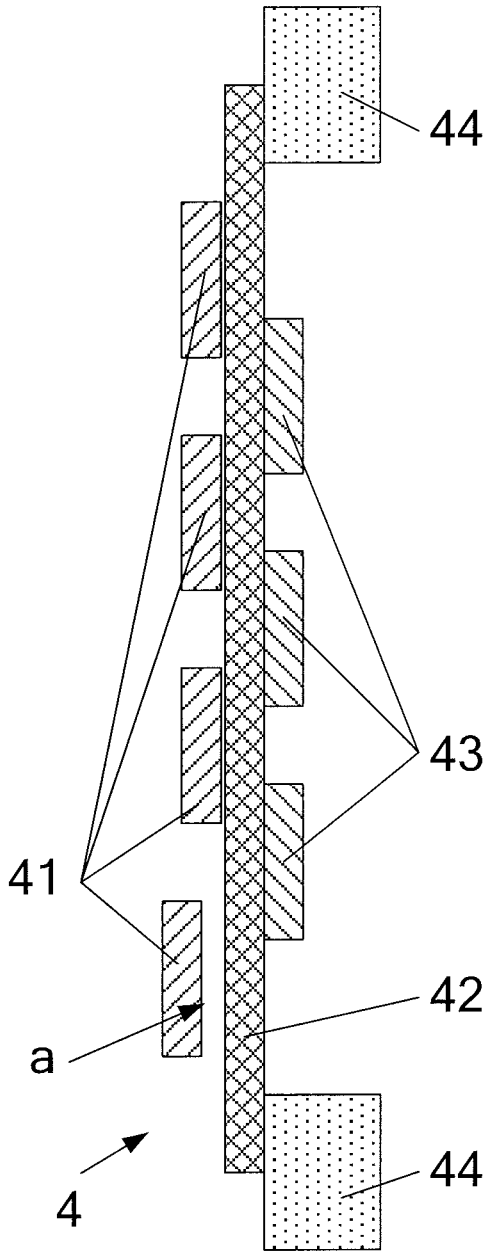
FIG. 6 is a schematic structural view of the mask shown in FIGS. 3 to 5.

In the specific embodiment shown in FIG. 3 of the present disclosure, the step of making the mask strip and the supporting and shielding strip move away from each other by the separation device at the spatial intersection region to increase the spacing between the mask strip and the supporting and shielding strip at the spatial intersection region includes: controlling symmetrically-disposed second air knives to blow the spatial intersection region with different air volumes, so that the mask strip and the supporting and shielding strip are moved away from each other by a resulting pressure difference of wind at the spatial intersection region to increase the spacing between the mask strip and the supporting and shielding strip at the spatial intersection region, thereby ensuring that more wind can enter the spatial intersection region to dry the cleaning solution (referring to FIGS. 3 and 6).

In the specific embodiment shown in FIG. 4 of the present disclosure, the step of making the mask strip and the supporting and shielding strip move away from each other by the separation device at the spatial intersection region to increase the spacing between the mask strip and the supporting and shielding strip at the spatial intersection region includes: controlling second air knives disposed in a staggered manner to blow the spatial intersection region with the same air volumes, so that the mask strip and the supporting and shielding strip are moved away from each other by a resulting pressure difference of wind at the spatial intersection region to increase the spacing between the mask strip and the supporting and shielding strip at the spatial intersection region, thereby ensuring that more wind can enter the spatial intersection region to dry the cleaning solution (referring to FIGS. 4 and 6).

In the specific embodiment shown in FIG. 5 of the present disclosure, the step of making the mask strip and the supporting and shielding strip move away from each other by the separation device at the spatial intersection region to increase the spacing between the mask strip and the supporting and shielding strip at the spatial intersection region includes: magnetically adsorbing by a magnetic adsorbing member the mask strip at the spatial intersection region, to bend and deform the mask strip at the spatial intersection region away from the supporting and shielding strip, so that the mask strip and the supporting and shielding strip are moved away from each other at the spatial intersection region to increase the spacing between the mask strip and the supporting and shielding strip at the spatial intersection region, thereby ensuring that more wind can enter the spatial intersection region to dry the cleaning solution (referring to FIGS. 5 and 6).

The above three specific embodiments can achieve the object of the present disclosure, that is, the spatial intersection region is opened to a greater extent, so that the internal cleaning solution is blown off. The purpose of these specific embodiments is not deviated from the design idea of the present disclosure, therefore they should fall within the scope of the present disclosure.

In summary, with the drying system provided by the embodiments of the present disclosure, when the plurality of first air knives air-dry the cleaned mask, the separation device allows the mask strip and the supporting and shielding strip to move away from each other at the spatial intersection region, to increase the spacing between the mask strip and the supporting and shielding strip at the spatial intersection region. As a result, it allows a better air circulation at the spatial intersection region, so that the cleaning solution in the spatial intersection region is blown away, avoiding the cleaning solution from remaining on the mask.

In the description of the present disclosure, the terms "install", "connect", "couple", "fix", etc., are to be understood broadly. For example, "connect" may be a fixed connection, or a detachable connection, or an integral connection, or they may be a direct connection, or an indirect connection through an intermediate media. For those skilled in the art, the specific meanings of the above terms in the present disclosure may be understood in accordance with specific conditions.

In the description of this specification, the terms "an embodiment", "some embodiments", "specific embodiments", etc., mean that the specific features, structures, materials or characteristics described in connection with the embodiments or examples are included in at least one embodiment or example of the present disclosure. In the present specification, the schematic representation of the above terms does not necessarily refer to the same embodiment or example. Furthermore, the specific features, structures, materials, or characteristics described may be combined in a suitable manner in any one or more embodiments or examples.

The embodiments disclosed in the present disclosure are as described above, but they are merely provided to facilitate the understanding of the present disclosure, and are not intended to limit the present disclosure. Any modifications and variations may be made by those skilled in the art in terms of form and detail without departing from the spirit and scope of the present disclosure, but the scope of the present disclosure is defined by the appended claims.

What is claimed is:

1. A drying system, comprising:

a drying chamber having a first side wall and a second side wall arranged opposite to the first side wall;

a plurality of first air knives on the first side wall and the second side wall for air-drying a cleaned mask; and a separation device for allowing a mask strip and a supporting and shielding strip to move away from each other at a spatial intersection region formed by the mask strip and the supporting and shielding strip to increase a spacing between the mask strip and the supporting and shielding strip at the spatial intersection region, when the plurality of first air knives are air-drying the cleaned mask.

2. The drying system according to claim 1, wherein the separation device comprises a magnetic adsorbing member.

3. The drying system according to claim 2, wherein the magnetic adsorbing member comprises a magnet or an electromagnet.

4. The drying system according to claim 3, wherein the plurality of first air knives form a plurality of groups of first air knives arranged at intervals, and any one group of the plurality of groups of first air knives has a same air volume, and the separation device is disposed between two adjacent groups of first air knives.

5. The drying system according to claim 2, wherein the plurality of first air knives form a plurality of groups of first air knives arranged at intervals, and any one group of the plurality of groups of first air knives has a same air volume, and the separation device is disposed between two adjacent groups of first air knives.

6. The drying system according to claim 1, wherein the separation device comprises second air knives disposed symmetrically on the first side wall and the second side wall, and the second air knife on the first side wall has a different air volume from the second air knife on the second side wall.

7. The drying system according to claim 6, wherein the plurality of first air knives form a plurality of groups of first air knives arranged at intervals, and any one group of the plurality of groups of first air knives has a same air volume, and the separation device is disposed between two adjacent groups of first air knives.

8. The drying system according to claim 1, wherein the separation device comprises second air knives disposed on the first side wall and the second side wall in a staggered manner.

9. The drying system according to claim 8, wherein the second air knife on the first side wall has a same air volume as the second air knife on the second side wall.

10. The drying system according to claim 9, wherein the plurality of first air knives form a plurality of groups of first air knives arranged at intervals, and any one group of the plurality of groups of first air knives has a same air volume, and the separation device is disposed between two adjacent groups of first air knives.

11. The drying system according to claim 8, wherein the second air knife on the first side wall has a different air volume from the second air knife on the second side wall.

12. The drying system according to claim 11, wherein the plurality of first air knives form a plurality of groups of first air knives arranged at intervals, and any one group of the plurality of groups of first air knives has a same air volume, and the separation device is disposed between two adjacent groups of first air knives.

13. The drying system according to claim 8, wherein the plurality of first air knives form a plurality of groups of first air knives arranged at intervals, and any one group of the plurality of groups of first air knives has a same air volume, and the separation device is disposed between two adjacent groups of first air knives.

14. The drying system according to claim 1, wherein the plurality of first air knives form a plurality of groups of first air knives arranged at intervals, and any one group of the plurality of groups of first air knives has a same air volume, and the separation device is disposed between two adjacent groups of first air knives.

15. The drying system according to claim 1, wherein the separation device comprises a magnetic adsorbing member; and wherein the separation device further comprises second air knives disposed symmetrically on the first side wall and the second side wall, and the second air knife on the first side wall has a different air volume from the second air knife on the second side wall.

16. The drying system according to claim 1, wherein the separation device comprises a magnetic adsorbing member; and wherein the separation device further comprises second air knives disposed on the first side wall and the second side wall in a staggered manner.

17. A drying method for a cleaning solution on a mask, comprising:

making a mask strip and a supporting and shielding strip move away from each other by a separation device at a spatial intersection region formed by the mask strip and the supporting and shielding strip to increase a spacing between the mask strip and the supporting and shielding strip at the spatial intersection region, so that the cleaning solution in the spatial intersection region is blown away, when the plurality of first air knives are air-drying the cleaned mask.

18. The drying method according to claim 17, wherein the making the mask strip and the supporting and shielding strip move away from each other by the separation device at the spatial intersection region formed by the mask strip and the supporting and shielding strip to increase the spacing between the mask strip and the supporting and shielding strip at the spatial intersection region comprises:

controlling symmetrically-disposed second air knives to blow the spatial intersection region with different air volumes, so that the mask strip and the supporting and shielding strip are moved away from each other by a resulting pressure difference of wind at the spatial intersection region to increase the spacing between the mask strip and the supporting and shielding strip at the spatial intersection region.

19. The drying method according to claim 17, wherein the making the mask strip and the supporting and shielding strip move away from each other by the separation device at the spatial intersection region formed by the mask strip and the supporting and shielding strip to increase the spacing between the mask strip and the supporting and shielding strip at the spatial intersection region comprises:

controlling second air knives disposed in a staggered manner to blow the spatial intersection region with a same air volume, so that the mask strip and the supporting and shielding strip are moved away from each other by a resulting pressure difference of wind from each other at the spatial intersection region to increase the spacing between the mask strip and the supporting and shielding strip at the spatial intersection region.

20. The drying method according to claim 17, wherein the making the mask strip and the supporting and shielding strip move away from each other by the separation device at the spatial intersection region formed by the mask strip and the supporting and shielding strip to increase the spacing between the mask strip and the supporting and shielding strip at the spatial intersection region comprises:

magnetically adsorbing by a magnetic adsorbing member the mask strip at the spatial intersection region, to bend and deform the mask strip at the spatial intersection region away from the supporting and shielding strip, so that the mask strip and the supporting and shielding strip are moved away from each other at the spatial intersection region to increase the spacing between the mask strip and the supporting and shielding strip at the spatial intersection region.

* * * * *